US006014980A

United States Patent [19]

Glatz

[11] Patent Number: 6,014,980

[45] Date of Patent: Jan. 18, 2000

[54] FREE-ARM CANOPY

[75] Inventor: Gustav Adolf Glatz, Frauenfeld, Switzerland

[73] Assignee: Glatz AG, Frauenfeld, Switzerland

[21] Appl. No.: 09/000,025

[22] PCT Filed: Jul. 25, 1996

[86] PCT No.: PCT/CH96/00267

§ 371 Date: Jan. 21, 1998

§ 102(e) Date: Jan. 21, 1998

[87] PCT Pub. No.: WO97/04682

PCT Pub. Date: Feb. 13, 1997

[30] Foreign Application Priority Data

Jul. 25, 1995 [CH] Switzerland ..... 2202/95

[51] Int. Cl.[7] ..... A45B 17/00; A45B 23/00; A45B 11/00

[52] U.S. Cl. ..... 135/20.1; 135/20.3; 135/21

[58] Field of Search ..... 135/15.1, 201, 135/20.3, 21

[56] References Cited

U.S. PATENT DOCUMENTS

| | | | |
|---|---|---|---|
| 2,905,187 | 9/1959 | Croce | 135/46 |
| 3,486,514 | 12/1969 | Prescott . | |
| 4,586,525 | 5/1986 | Glatz et al. | 135/21 |
| 4,606,366 | 8/1986 | Collet . | |
| 5,116,258 | 5/1992 | Vennik | 135/20.3 |
| 5,678,585 | 10/1997 | May | 135/30.1 |
| 5,735,302 | 4/1998 | Saliva | 135/20.1 |
| 5,785,069 | 7/1998 | Glatz | 135/20.1 |

FOREIGN PATENT DOCUMENTS

| | | | |
|---|---|---|---|
| 0466661 A1 | 1/1992 | European Pat. Off. | A45B 23/00 |
| 3229776 A1 | 4/1983 | Germany | A45B 23/00 |
| 3307718 A1 | 9/1984 | Germany | A45B 23/00 |
| 3339163 A1 | 3/1985 | Germany | A45B 23/00 |
| WO95/23532 | 9/1995 | WIPO | A45B 23/00 |

*Primary Examiner*—Robert Canfield
*Attorney, Agent, or Firm*—McCormick, Paulding & Huber LLP

[57] ABSTRACT

A jib (8) can be extended and retracted on the mast (2) and supported by means of mutually parallel connecting struts (16, 18). The struts are articulated secured to the mast (2) and the jib (8), while the jib can be secured in the extended position by means of a first clip (36) and bears a folding canopy (10) at the end away from the mast (2). The jib (8) is guided on the mast (2) and the struts (16, 18) so as to swivel, and can be secured in the swiveled position by a securing device (26, 28).

23 Claims, 7 Drawing Sheets

FREE-ARM CANOPY

TECHNICAL REALM

The invention relates to a free-arm canopy as set out in the introductory part of Patent claim 1.

STATE OF TECHNOLOGY

Free-arm canopies of the type mentioned at the outset are well known, for example, from U.S. Pat. No. 4,606,366. The free-arm canopy, shown in FIGS. 34 to 43 of said patent, has at the upper end of a mast a luffing jib which bears on one end an articulated folding canopy. The end of the jib that faces away from the canopy is connected to the mast by means of articulated struts. Turning down the struts will cause the jib to retract and the canopy to close. By turning the struts upward, the jib will extend and simultaneously open the canopy because one end of a rope of a control device is fastened to a slider which is connected to canopy rods. The rope is guided upwards by a canopy pole, articulated on the jib, and runs along the jib up to the mast at which the other end of the rope is rigidly secured. Due to the rigid fastening of the rope to the mast on the one hand and to the slider of the canopy on the other hand, the canopy is open only if the jib assumes a certain extended position. A height adjustment of the jib and consequently of the canopy is not possible. It is also not possible to swivel the jib around its axis and to swivel the canopy around the axis of the jib.

Other free-arm canopies are known from DE-A-33 39 163, DE-A-33 07 718 and EP-A-O 466 661. Also, in these cases it is not possible to swivel the canopy around the axis of the jib.

A free-arm canopy is described in U.S. Pat. No. 905,187 which allows the canopy to swivel around the axis of the jib while the swivelled position can be secured by means of a fastening device. Due to the fact that the canopy is situated in an unstable equilibrium position above the jib, there is the risk when disengaging the securing device, especially when adjusting the swivelled position, that the canopy will make an undesired swivel motion as a result of its weight and will come to rest below the jib. Due to the absence of stabilizing struts, the described forms of constructions are limited to comparatively small canopies. In addition, the inclination of the jib in relation to the mast cannot be changed. Consequently, the height of the canopy is not adjustable.

DE-A-32 29 776 describes a free-arm canopy in which the jib articulates on the mast by means of a universal joint. The jib can be slid in the longitudinal direction by loosening a setscrew. With respect to inclination and swivelled position, the jib can be adjusted around its longitudinal axis. The disadvantage here is that when loosening the setscrew, the jib is free to move, thus creating the risk of the canopy folding or turning down unintentionally and the operator becoming injured. Such a free-arm canopy is difficult to handle and completely unsuitable for larger free-arm canopies.

REPRESENTATION OF THE INVENTION

It is the task of the invention to further improve a free-arm canopy of the type mentioned at the outset.

This problem is solved, according to the invention, by the free-arm canopy, as set out in claim 1. On the one hand this refinement makes it possible to adjust the height of the canopy within certain limits in order to change the ground clearance and to adapt the canopy, for example, to persons of a certain height and, on the other hand, to swivel the canopy around the axis of the jib and thus to swivel the canopy around the axis of the jib in such a way as to achieve improved sun and/or wind protection. The latter can still be improved by making it possible to swivel the canopy around the axis of the mast. Furthermore, such a free-arm canopy provides special security against unintentional folding because the jib, due to bearing the canopy on its free end and due to the connecting element, cannot retract into the normal position or fold down if, for any reason, the stopping device is not effective, which means if it has not been activated.

Advantageous refinements of the free-arm canopy are described in claims 2 to 23.

Claim 2 describes an advantageous refinement of a control device for opening and closing the canopy.

There are various forms of construction which allow the jib to turn and thus the canopy to swivel around the axis of the jib. Basically, it is possible to use a jib which is multi-cornered in cross-section and which is positioned in a rotary body with a rotationally symmetric outer surface. The rotary body on its part pivots in a corresponding bearing block. A particularly simple form of construction is described in claim 3. The swivelling of the jib can also be realized by a refinement of the free-arm canopy as set out in claims 4 and/or 5.

There are several refinements to secure the rotary position of the jib and thus the swivelled position of the canopy. Claim 6 describes a very simple solution whereas claim 7 describes a particularly easy refinement.

It is basically possible to actuate the canopy to open according to the variants of technical developments mentioned at the outset. A particularly simple solution is described in claim 8. It is possible, according to the aforementioned claim, to execute the extension and/or retraction procedure of the jib independently from opening the canopy, so that both manipulations can be made in succession. Consequently, the individual procedure will require less effort or rather larger things can be moved with little effort. Opening the canopy independently of the degree of extension of the jib allows in particular the extension of the jib and/or the opening of the canopy to be made gradually and independently of each other. The pulling device can be guided and returned via sliding guides but more advantageously via guide pulleys, as set out in claim 9, which facilitate the actuation. Also the tackle-block-like refinement of the positioning of the guide pulley on the slider, as set out in claim 10, additionally improves the actuation and the stability in the articulated area, particularly if it involves large canopies. The stability of the open canopy can be improved by a form of construction as set out in claim 11.

Also efficient is a form of construction of the free-arm canopy, as set out in claim 12, according to which the alignment of the canopy can be adjusted in relation to the jib.

Claim 13 describes an additional possibility of adjusting the position of the canopy in vertical sense.

There are various possibilities for securing the position of the canopy vertically. Claim 14 describes a very simple refinement in which the connecting bolt on the jib and on the mast is stationary, and the effective length can be adjusted by selecting suitable boreholes on the connecting struts. Alternatively or additionally, the vertical position can also be adjusted by placing the connecting bolt, as set out in claim 15, at various positions on the mast.

A very simple and stable form of construction of the connecting element is described in claim 16. Due to the connecting component, the connecting struts and consequently the whole canopy is of a relatively rigid construction, which guarantees an improved lateral rigidity of the connecting struts and therefore an improved stability of the whole free-arm canopy, particularly when the canopy is in an open state. Furthermore, it provides an increased resistance to wind loads. The connecting link between the connecting struts can, in addition, also serve as a stop in order to prevent a complete folding of the frame, particularly in the case of the retracted jib. This will not only reduce the risk of injury by getting fingers or other parts of the body caught in the folded frame, but it will also improve particularly the initiation of the extension procedure of the jib, since the extension is not executed from the dead-center position of the folded frame.

A particularly simple solution of the free-arm canopy is described in claim 17, in which the detent device comprises preferably a flexible connecting device, for example, a chain or a rope which can be fastened at various lengths between the connecting struts and the mast. For example, clamping elements can be used for clamping a rope, or simple hooks can be used for suspending a chain from various chain links. As a connecting device, it is also possible to use a swivel arm with various detent recesses which, according to its various recesses at different lengths, can be locked with a corresponding pin at different lengths Thus, the jib, and, therefore, also the connected canopy can be kept in different positions of inclination and at different heights of the canopy. The same effect can also be obtained with an alternative design, as set out in claim 18, in which a slide, movable along the mast, can be fastened to the mast at different heights by means of a stopping device. Such a detent device can be refined in different ways and can have, e.g., a setscrew on the slide which can clamp the slide at various heights on the mast. It is also conceivable to have a stop bolt which can engage into various detent openings along the mast. Furthermore, it is possible to use a block to stop the slide. Furthermore, a rack-and-pinion drive with a self-locking drive for a pinion is also conceivable.

Claim 19 describes another advantageous solution for opening the canopy, as well as for securing the canopy in the open state.

Due to the refinement, as set out in claim 20, the open canopy can be secured at a specified, angular position relative to the axis of the jib, thus preventing the canopy from tipping e.g., through wind influence. Claim 21 describes a particularly advantageous refinement in order to ensure a smooth opening procedure of the canopy, as well as a reliable detent of the canopy in a specified, angular position in relation to the axis of the jig.

Due to the refinement, as set out in claim 22, the canopy can be selectively secured in one of several angular positions in relation to the axis of the jib. This makes it possible, for example, to adapt the angular position of the canopy to the position of the sun as it changes during the course of the day. The refinement, as set out in claim 23, allows a simple and easy adjustment of the angular position of the open canopy in relation to the axis of the jib.

BRIEF DESCRIPTION OF THE DRAWINGS

Examples of forms of construction of the free-arm canopy, according to the invention, are described below in greater detail, based on drawings. The drawings show the following.

WAYS TO IMPLEMENT THE INVENTION

Figure 1:
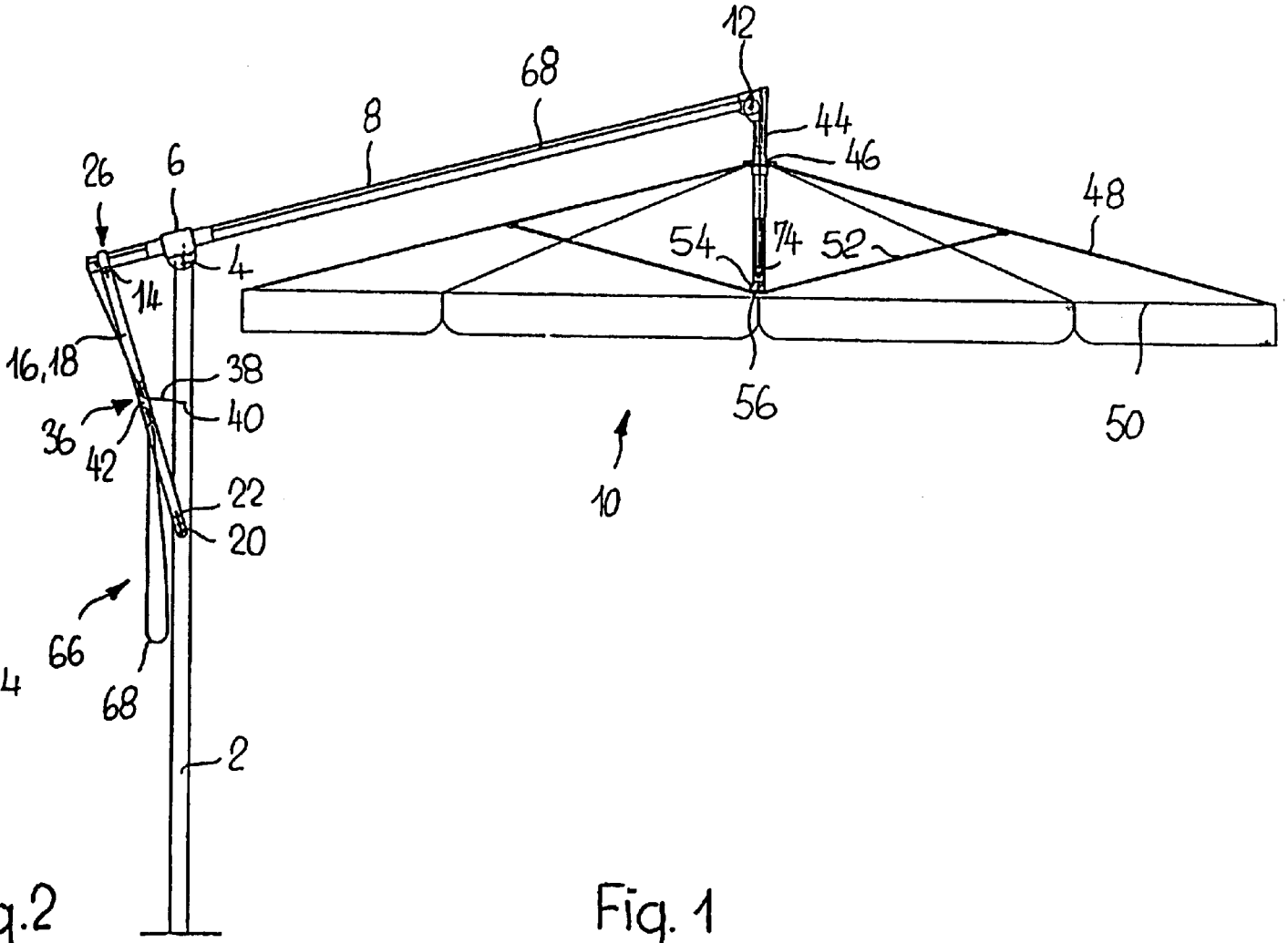
FIG. 1 is a side view and partly a sectional view of a free-arm canopy in an open state.
Figure 2:
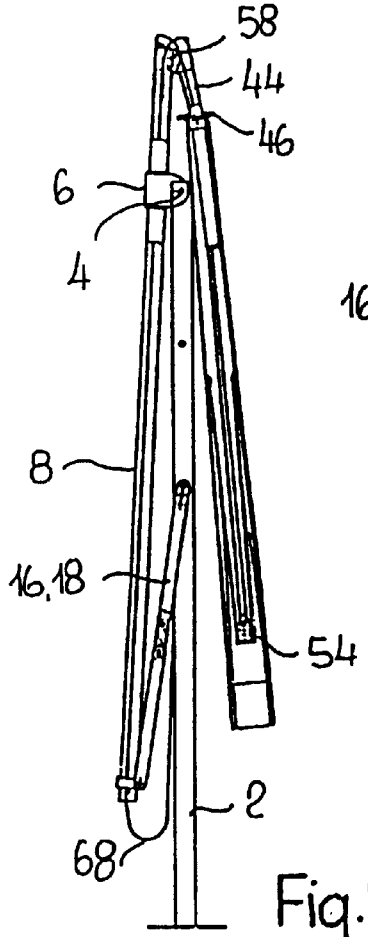
FIG. 2 is a side view and partly a sectional view of the free-arm canopy of FIG. 1 in a closed position.
Figures 3, 4:
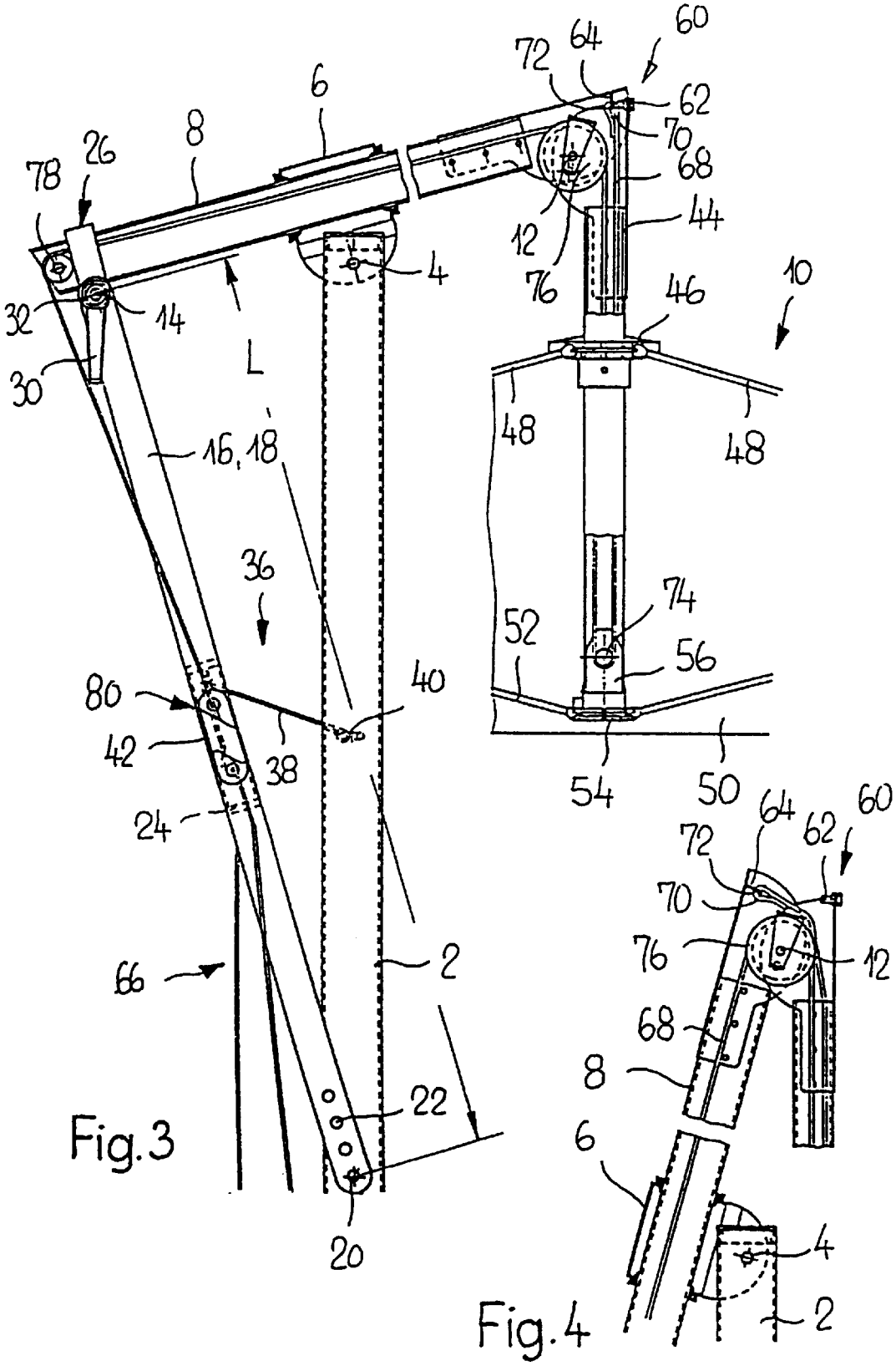
FIG. 3 is a partly sectional view of the free-arm canopy of FIG. 1, shown at a larger scale.
FIG. 4 is a sectional view of the free-arm canopy of FIG. 3, shown in a closed position.
Figure 5:
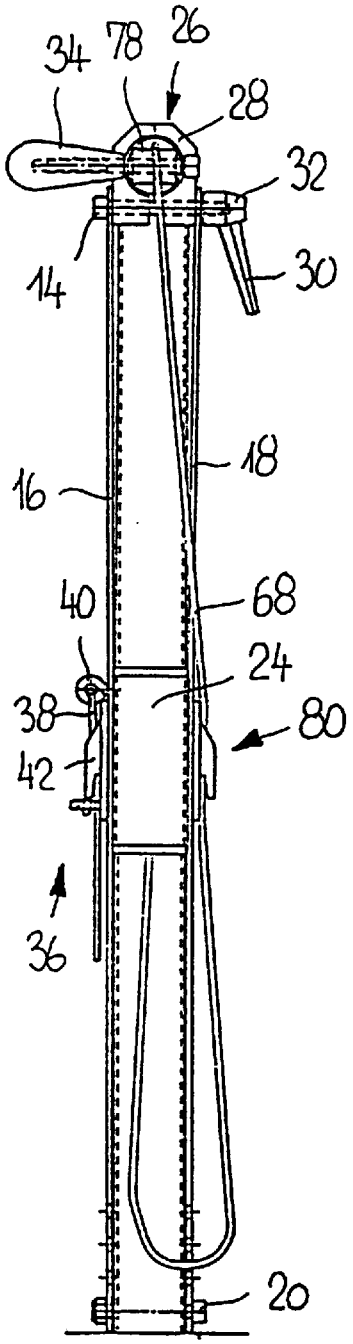
FIG. 5 is a side view, turned by 90°, showing the connecting struts of the free-arm canopy of FIG. 3.

FIGS. 1 to 5 show an initial form of construction of a free-arm canopy. The latter contains a mast (2) at the upper end of which a bearing block (6) is connected via an articulation (4). A jib (8),which can be slid lengthwise, rests in a tilted manner in the bearing block (6). The jib has a circular cross-section and is, as far as that is concerned, also pivotally attached to the bearing block (6). A foldable canopy (10) is positioned at one end of the jib (8) via an articulation (12). At the end of the jib (8) which faces away from the canopy (10) a connecting element (16, 18) is articulated via a connecting bolt (14). The connecting element (16, 18) on its part is articulated secured to the mast (2) via connecting bolts (20). In the illustrated example, the connecting element has two connecting struts (16 and 18), which are positioned parallel to each other and are made of a flat material. As an alternative, a single profile rod, e.g., with a U-shaped profile and/or with forked end pieces, can be used as a connecting element. At one end, which here is the end facing the mast, the connecting struts (16, 18) have various boreholes (22) for fastening the connecting bolt (20) in order to adjust the actual length L of the connecting struts (16, 18). Various boreholes can also be positioned at the end of the connecting struts (16, 18) facing the jib. The connecting struts are connected to one another via a connecting link (24) which is situated approximately at half length of the connecting struts in order to increase the bending resistance of the connecting struts (16, 18). At the end of the connecting struts (16, 18) facing the jib, the connecting bolt (14) is positioned in a bearing part (26) in which the jib arm is positioned so as to swivel. The bearing part (26) has a divided bearing ring (28), while the connecting bolt (14) is constructed as a clamping screw which contains a nut (32) that has been provided with a handle (30) in order to arrest the jib (8) in its rotating position by clamping the bearing ring around the jib. In addition, the jib (8) has a projecting handle (34) at right angles to its axis, by means of which the jib can swivel around its axis.

Located between the mast (2) and the connecting struts (16, 18) is a first detent device (36) which has a flexible connecting device (38) that in the case at hand is a rope. The flexible connecting device (38) is secured to the mast (2) at a fixed point (40) and can, at various lengths, be fastened to a clamping element (42) at the connecting struts (16,18) in order to secure the extended jib in its position. Instead of a rope the connecting device can also be a chain, and the clamping element can be constructed as a simple hook, so that the chain can be adjusted to the desired, actual length simply by suspending the chain from various chain links. In place of a chain, it is also possible to use a swivel arm, which is not illustrated here, that swivels on the mast and has various arresting recesses by means of which the swivel arm can be secured to the connecting struts in various effective lengths via a stopping pin.

The foldable canopy (10) is equipped with a canopy pole (44) on which a crown (46) is fastened. Rods are articulated on the crown which support the canopy membrane (50). Articulated on the canopy rods (48) are supporting struts (52) which on their part are articulated secured to a slide (54) which has a pole component (56) which, when the canopy is in the open state, engages into the hollow canopy pole (44). The canopy pole (44) is connected to the jib (8) in a tiltable and levelling manner by means of an articulation (12). A levelling device (60) with a levelling screw (62) positioned at the canopy pole (44) and a stop (64) located at the jib, serves the purpose of adjusting selectively the relative position between the canopy (10) and the jib (8) when the jib is in the extended state.

An actuating device (66) is used to open and close the canopy. The control device is equipped with a pulling mechanism (68), preferably a rope. The end (70) of the rope which faces the canopy is fastened to the jib (8) at a fixed point (72)which can be located either on the canopy pole or preferably on the jib (8). If the latter is the case, the pulling device can be guided from the jib to the canopy pole (44) via a guide pulley, which is not illustrated in detail here. The pulling device (68) runs in a tackle-block manner through the hollow canopy pole (44) to the slider (54) at which it is returned to the jib (8) via a guide pulley (74). At the articulation (12) the pulling device (68) runs over a guide pulley (76) and continues through the hollow jib (8). At the end which faces away from the canopy (10), the pulling device (68) is led out of the jib, e.g., via a guide pulley (78) which is positioned at the end of the jib (8) that faces away from the canopy. The canopy (10) is opened by pulling the pulling mechanism (68), i.e. the slider (54) is moved against the canopy pole (44) until the pole component (56) engages into the canopy pole (44). The pulling mechanism can be fixed into position by means of a securing device (80), e.g., by a clamping device positioned at the connecting struts (16, 18). Thus, the canopy can be kept in an open state or in a desired position relative to the jib.

Figure 6:
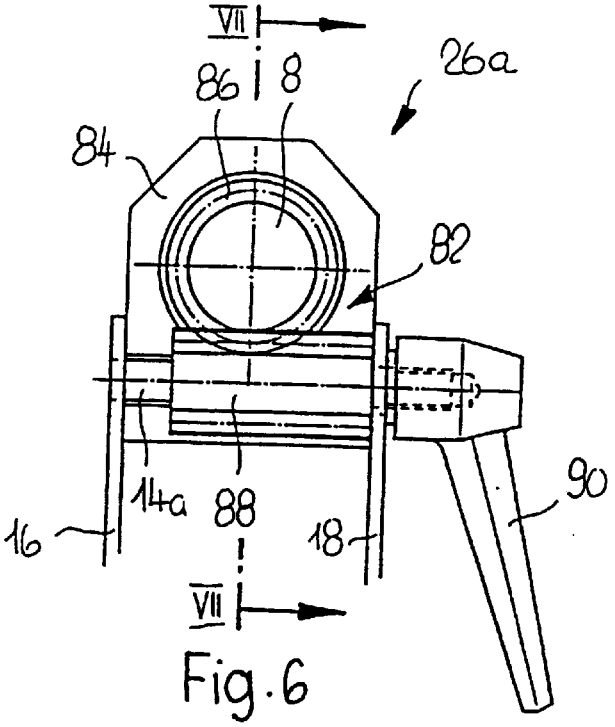
FIG. 6 is a modified bearing part with a worm gear shown at right angles to the axis of the jib.
Figure 7:
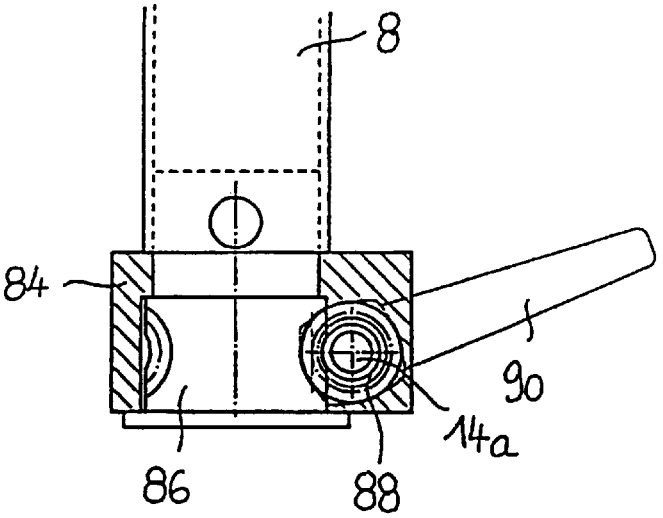
FIG. 7 shows the worm gear of FIG. 6, according to section VII—VII of FIG. 6.

FIGS. 6 and 7 show a modified form of construction of the bearing part (26*a*) at the end of the jib (8). A self-locking worm gear (82) has been provided for turning the jib around and for fixing it into position. For this purpose the bearing part (26*a*) contains in a holding part (84) a worm wheel (86) which is firmly fastened to the jib (8). The worm wheel (86) interacts with a worm shaft (88) which is positioned on a connecting bolt (14*a*) to which also the connecting struts (16, 18) are fastened. The connecting bolt (14*a*) has been provided with a handle (90) by means of which the worm shaft (88) can be turned and thus the jib (8) can be swivelled via the worm wheel. Due to the sel-flocking characteristic of the worm gear (82) an additional detent device is no longer required.

Figures 8, 9:
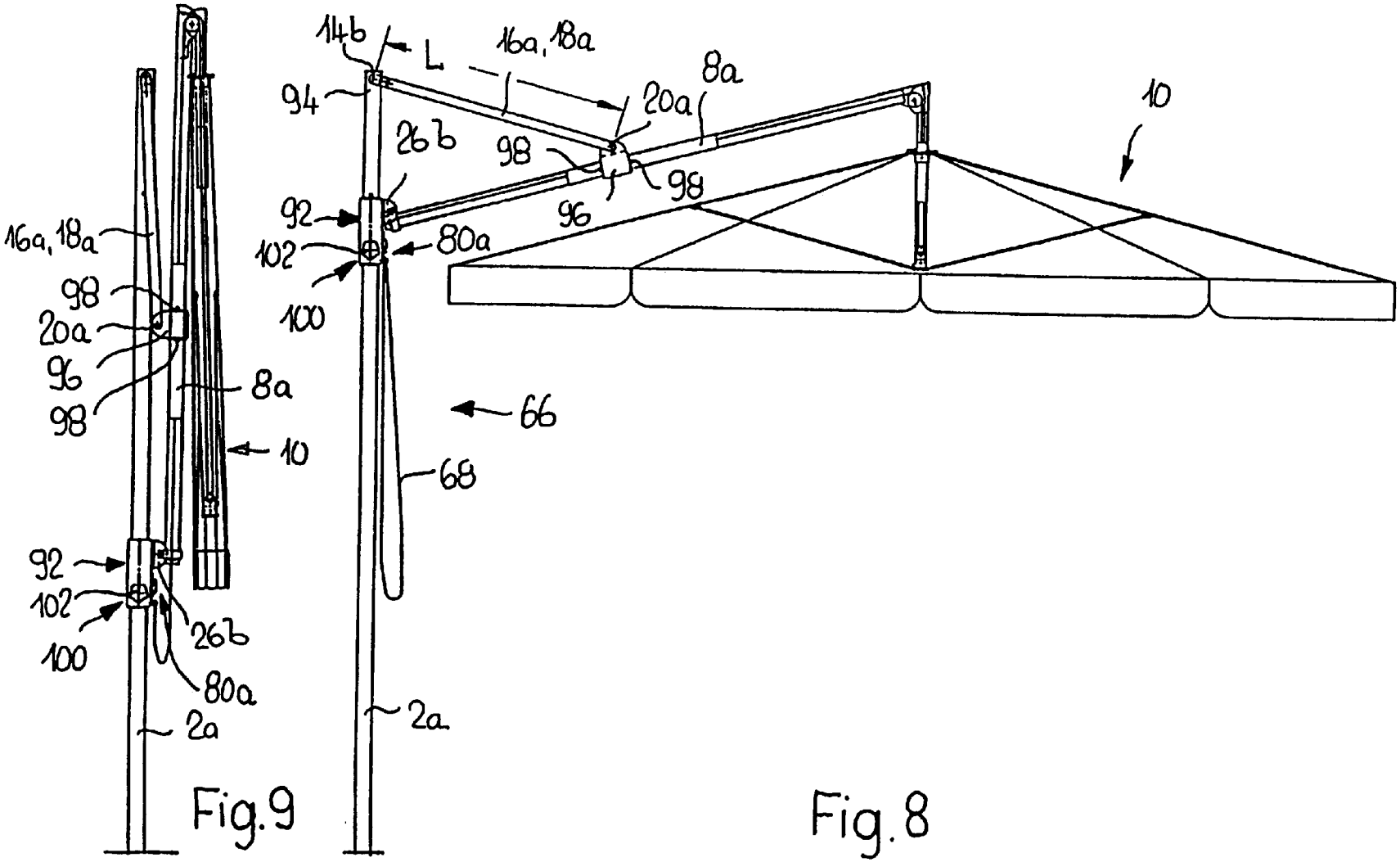
FIG. 8 is a side view and partly sectional view of another free-arm canopy in an open state.
FIG. 9 is a side view and partly sectional view of the free-arm canopy of FIG. 8, shown in a closed position.

FIGS. 8 and 9 show a modified form of construction of a free-arm canopy, in which a jib (8*a*) supports itself against a mast (2*a*) via a slide (92) which is designed to move along the mast. The slide (92) has a bearing part (26*b*) in which the jib (8*a*) swivels around its axis by the end which faces away from the canopy (10). The bearing part (26*b*) can be constructed analogous to that shown in FIGS. 1 to 7. On the one hand, the connecting struts (16*a* and 18*a*) are secured to the upper end (94) of the mast (2*a*), via a connecting bolt (14*b*) and, on the other hand, are fastened by means of another connecting bolt (20*a*) to a bearing block (96), positioned at the jib (8*a*) between the ends of the latter. The jib (8*a*) swivels in the bearing block (96). Limiting stops (98) secure the bearing block (96) firmly to the jib in the axial direction of the jib (8).

The slide (92) which can be moved along the mast (2*a*) and against which the jib (8*a*) supports itself, has been provided with a first detent device (100) which has a clamping screw (102) by means of which the slide (92) can be fixed into position at various heights on the mast (2*a*). Depending on the vertical position, the inclination of the canopy and also to a certain extent the distance to the bottom will vary. The construction of the canopy (10) and that of the actuating device (66) for opening and closing the canopy corresponds to that shown in FIGS. 1 to 7, so that reference is made to the construction as shown in the aforementioned figures. It should be added in this connection that the securing device (80*a*) for fastening the pulling mechanism is positioned on the slide (92) so that the canopy can be inclined in the open state. Alternatively or in addition to securing the height of the slide (92) on the mast (2*a*), the connecting struts (16*a*, 18*a*) can be provided with rows of holes at one or at both ends, due to which the effective length L of the connecting struts and thus the ground clearance of the canopy can be varied. It is also possible to provide various boreholes on the jib (8*a*), running in the longitudinal direction, for the purpose of changing the limiting stops (98) along the jib in order to adjust the height of the canopy (10). The canopy can be swivelled around the axis of the jib in the manner as already described, based on FIGS. 1 to 7.

Figure 10:
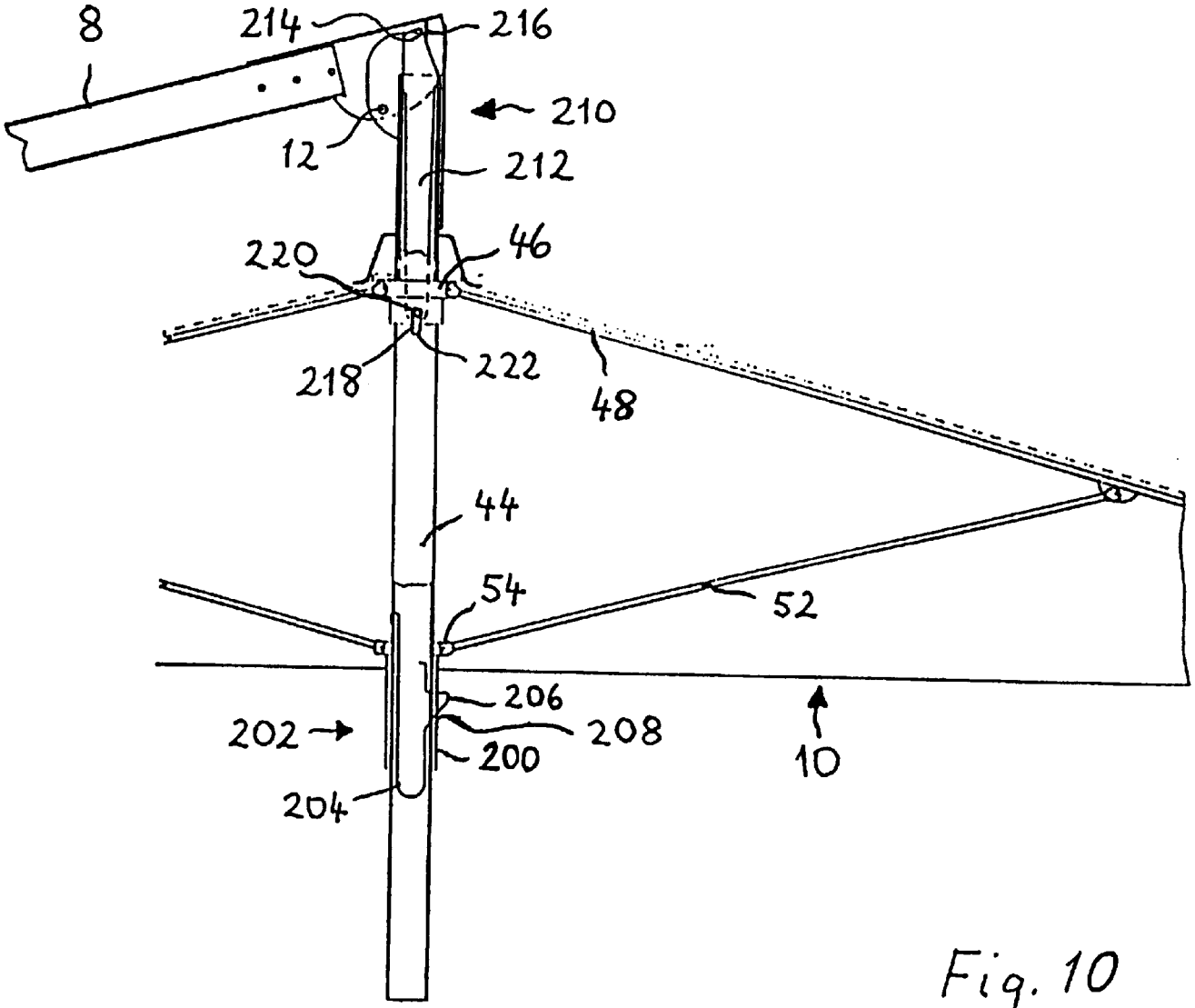
FIG. 10 is a side and partly sectional view of another free-arm canopy, shown in an open state.
Figure 11:
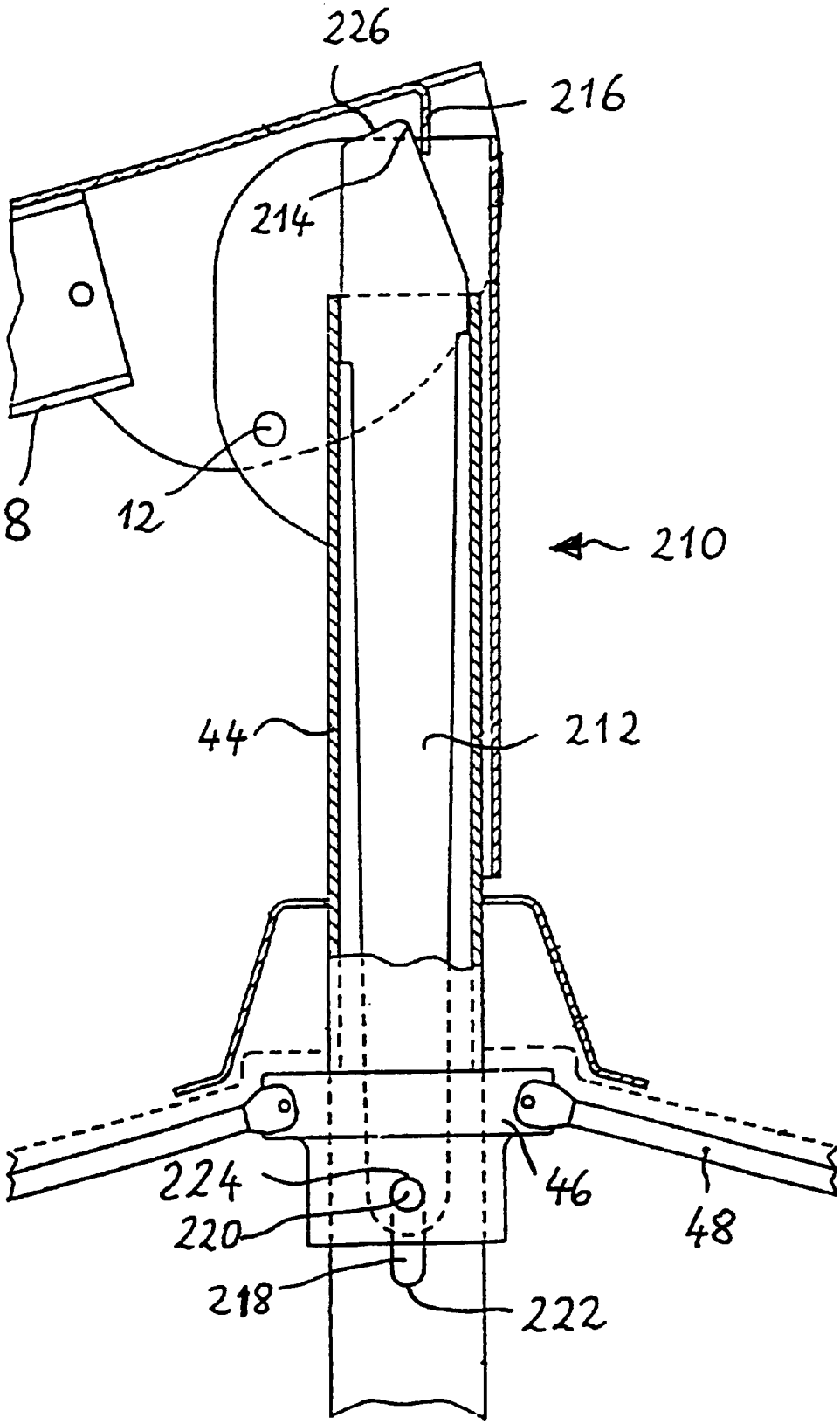
FIG. 11 is a side and partly sectional view of the third detent device of the freearm canopy of FIG. 10, shown at a larger scale.

FIGS. 10 and 11 show another modified form of construction of a free-arm canopy in which the slider (54) has been provided with a guiding device (200) which interacts with a canopy pole (44), articulated on the jib (8 or (8*a*). The canopy (10) can be secured in the open state by means of a disengaging second detent device (202). In the illustrated form of construction, the guiding device (200) is of tubular construction and is guided in a longitudinally adjustable manner along the tubular canopy pole (44). The second detent device (202) comprises a detent spring (204) which has a stopping part (206) that protrudes from the canopy pole (44). The stopping part can engage into a corresponding longitudinal slot (208) of the guiding device (200) in such a way that the canopy (10) can be secured in the open state. The second detent device (202) can be disengaged by pressing the stopping part (206). The length of the canopy pole (44) is such that the guiding device (200) interacts with the canopy pole (44) at least in the open state of the canopy.

The canopy (10) can be secured in the open state at an angular position in relation to the axis of the jib (8 or 8*a*) and in a swivel direction by means of a third detent device (210). The third detent device (210) contains a detent element (212), provided with an upper stop face (214), which can be slid lengthwise inside the canopy pole (44). When opening the canopy (10), the detent element (212) can be slid upward in such a way that the stop face (214) interacts with a stop (216) formed at the jib (8 or 8*a*). The crown (46) which embraces the canopy pole (44) can be slid lengthwise on the latter. Furthermore, the crown (46) is connected to the detent element (212) by at least one connecting bolt (220) which is guided through longitudinal slots (218) in the canopy pole (44). The downward movement of the crown (46), caused particularly by the weight of the canopy, is limited by the lower ends (222) of the longitudinal slots (218). The upward movement of the crown (46), caused particularly by an upwardly directed, applied force to open the canopy, as well as by an upwardly directed tension of the canopy in the open state of the canopy (10), is limited by the upper ends (224) of the longitudinal slots (218). In the illustrated form of construction, the detent element (212) is provided at the upper end with an abutting surface (226) and a stop face (214) which renders a ratchet-like interaction with the stop (216) possible. When swivelling the canopy around the articulated axis (12) from a position parallel to the jib (8 or 8*a*) to the service position, as illustrated in FIGS. 10 and 11, the stop (216) crosses the abutting surface (226) while forcing the detent element (212) back until the stop face (214) interlocks with the stop (216), thus securing the canopy in its position on the jib (8 or 8*a*).

Figure 12:
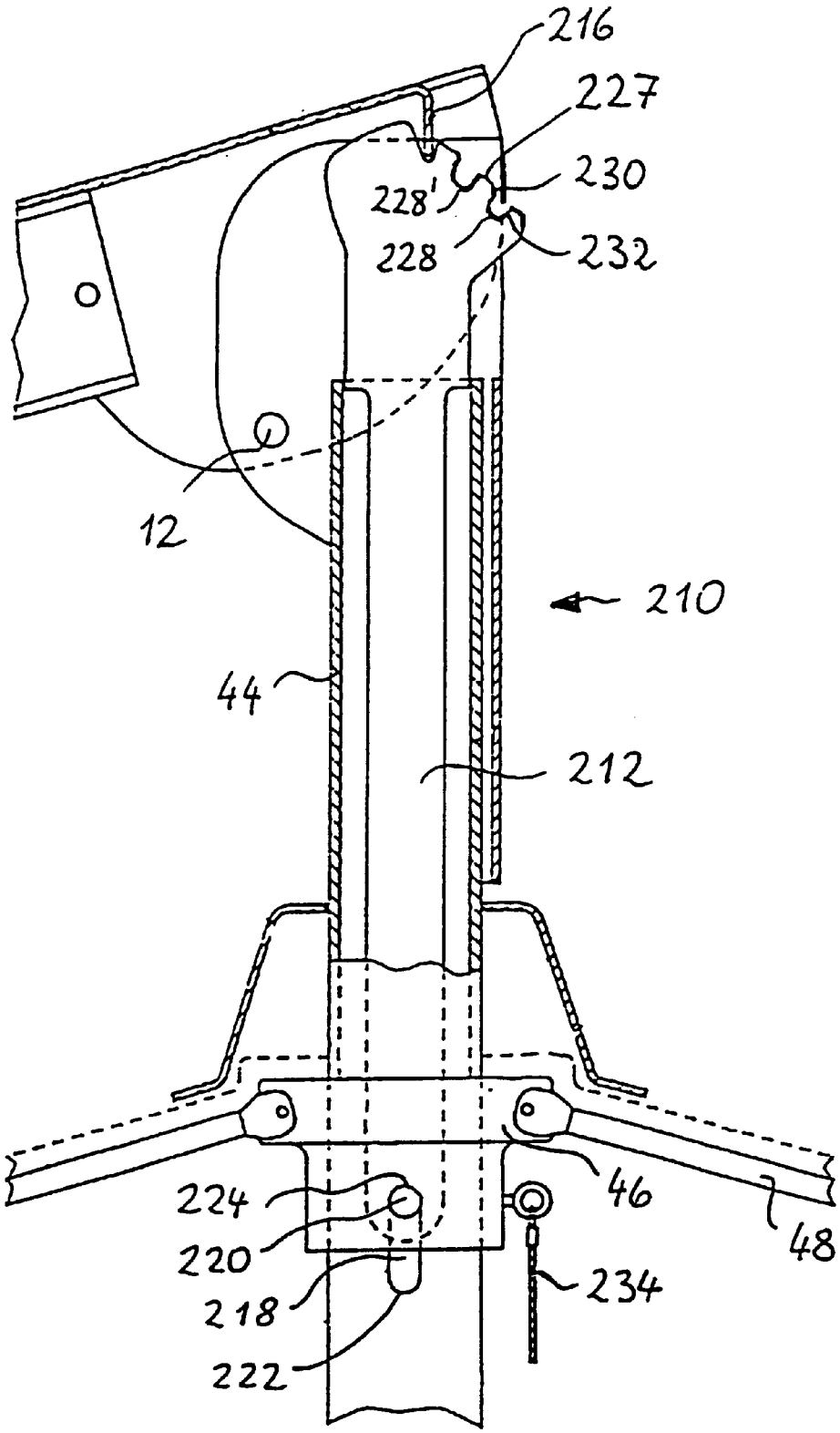
FIG. 12 is a side view and partly a sectional view of another, third detent device of a free-arm canopy.

Another form of construction of a third detent device (210) is shown in FIG. 12. A frontal area (227) of a detent element (212) has been provided with several detent recesses (228, 228' etc.) into which—when the canopy (10) is open—the stop (216) selectively engages, depending on the desired angular position of the canopy pole (44). The recesses (228, 228' etc.) have first blocking surfaces (230) as well as second blocking surfaces (232) which allow an interaction between stop element (212) and stop (216). Alternatively to the illustrated example of construction shown in FIG. 12, the recesses can be formed on the stop (216), and the detent element (212) can be provided with a corresponding pin which engages into the recesses. The crown (46) has been provided with a pulling device (234), preferably a rope, by means of which—when the canopy (10) is in the open state—the detent element (212) with its stop face (214) can be disengaged from the stop (216) by overcoming the upwardly directed tension of the canopy. In doing so, the canopy pole (44) can be swivelled when the canopy (10) is in an open state, and, e.g., can become re-engaged at a different angular position. As an alternative, the pulling device (234) can be fastened to the connecting bolt (220) or to the detent element (212), in which case the pulling device (234) can be guided downward through the hollow canopy pole (44).

List of Reference Numerals

2 Mast
2*a* Mast
4 Articulation
6 Bearing Bracket
8 Jib
8*a* Jib
10 Canopy
12 Articulation
14 Connecting Bolt
14*a* Connecting Bolt
14*b* Connecting Bolt
16 Connecting Strut
16*a* Connecting Strut
18 Connecting Strut
18*a* Connecting Strut
20 Connecting Bolt
20*a* Connecting Bolt
22 Borehole
24 Connecting Link
24*a* Connecting Link
26 Bearing Part
26*a* Bearing Part
26*b* Bearing Part
28 Bearing Ring
30 Handle
32 Nut
34 Handle
36 First Detent Device
38 Flexible Connecting Device
40 Fixed Point
42 Clamping Element
44 Canopy Pole
46 Crown
48 Canopy Rod
50 Canopy Membrane
52 Supporting Strut
54 Slider
56 Pole Component
60 Leveling Device
62 Levelling Screw
64 Stop
66 Control Mechanism [also "Actuating Device"]
68 Pulling Device
70 End
72 Fixed Point
74 Guide Pulley
76 Guide Pulley
78 Guide Pulley
80 Securing Device
80*a* Securing Device
82 Worm Gear
84 Holding Part
86 Worm Wheel
88 Worm Shaft
90 Handle
92 Slide
94 Upper End
96 Bearing Bracket
98 Limit Stop
100 First Detent Device
102 Clamping Screw
200 Guiding Device
202 Second Detent Device
204 Detent Spring
206 Stopping Part of Detent Spring
208 Longitudinal Slot of Guiding Device
210 Third Detent Device
212 Detent Link
214 Stop Face
216 Stop
218 Longitudinal Slot
220 Connecting Bolt
222 Lower End of Longitudinal Slot
224 Upper End of Longitudinal Slot
226 Abutting Surface
227 Frontal Area
228, 228' Recesses
230 First Blocking Surfaces
232 Second Blocking Surfaces
234 Pulling Device

I claim:

1. A free arm-canopy including a mast (2, 2*a*) on which a jib (8, 8*a*) is guided for movement between extended and retracted positions and is supported by means of a connecting strut (16, 18, 16*a*, 18*a*) which is articulately secured to the mast (2, 2*a*) and to the jib (8, 8*a*), the jib being securable in the extended position by means of a first detent device (36, 100) and carrying an articulated folding canopy (10) at an end thereof facing away from the mast (2,2*a*), said canopy having a crown (46) with articulated canopy rods (48) on which supporting struts (52) are articulated, which supporting struts are articulated on a slider (54), the jib (8, 8*a*) being guided on the mast (2, 2*a*) and on the strut (16, 18, 16*a*, 18*a*) such that it may swivel about its own axis, and a securing device (26, 26*a*, 26*b*, 28, 82) for securing the jib in a swiveled position.

2. The free-arm canopy, as set forth in claim 1, is characterized by the fact that the slider (54) interacts with a pulling mechanism (68) of an actuating device (66) which is guided to the mast (2, 2*a*) in the direction of the jib (8, 8*a*).

3. The free-arm canopy, as set forth in claim 1, is characterized by the fact that the jib (8, 8*a*) has a circular cross-section.

4. The free-arm canopy, as set forth in claim 3, is characterized by the fact that the jib (8) is guided in a longitudinally slidable manner in an articulated supported bearing block (6) at the top of the mast (2) and that the end of the jib (8) which faces away from the canopy (10) is guided in a bearing part (26, 26*a*) on which the connecting strut (16, 18) is articulated.

5. The free-arm canopy, as set forth in claim 3, is characterized by the fact that the end of the jib (8) which faces away from the canopy (10) pivots in a bearing part (26*b*), which is positioned in a slide (92) that can be slid along and be secured to the mast (2*a*), while the connecting strut (16*a*, 18*a*) is articulated on a bearing block (96) positioned on the jib (8*a*), in the area between the mast (2*a*) and the canopy (10).

6. The free-arm canopy, as set forth in claim 4, is characterized by the fact that the bearing part (26, 26*b*) is designed as a securing device and is provided with a divided bearing ring (28) which is braced against the jib (8) by means of a tension screw (20) and, furthermore, that a handle (34) projecting crosswise is positioned on the jib (8) for the purpose of swivelling the jib.

7. The free-arm canopy, as set forth in claim 4, is characterized by the fact that the bearing part (26*b*), serving as a driving and securing device, is provided with a self-locking worm gear (82) which has a worm wheel (86), positioned at the jib (8), and a worm shaft (88) connected to a handle (90).

8. The free-arm canopy, as set forth in one of claim 2, is characterized by the fact that the actuating device (66) is provided with a pulling device (68) which is guided by the slider (54) to the jib (8, 8*a*) while passing through the canopy pole (44) and, furthermore that the pulling device is guided to the outside on the end of the jib which faces the mast, and that the pulling device is fastened in its extended length to a securing device (80, 80*a*).

9. The free-arm canopy, as set forth in claim 8, is characterized by the fact that the pulling device (68) is guided over pulleys (74, 76, 78) at places of return.

10. The free-arm canopy, as set forth in claim 8, is characterized by the fact that the end of the pulling device (68) on the slider (54) which faces the canopy, is guided back to the canopy pole (44) or to the jib (8) via a guide pulley (74) where it is fastened to the canopy pole or to the jib.

11. The free-arm canopy, as set forth in claim 8, is characterized by the fact that the slider (54) is positioned on a pole component (56), the free end of which is connected to the pulling device (68), and which, when the canopy (10) is in the open state, engages into the hollow canopy pole (44).

12. The free-arm canopy, as set forth in one of claim 8, is characterized by the fact that between the canopy pole (44), articulated on the jib (8,8*a*), and the jib (8, 8*a*) an adjustable levelling device (62), has been provided which limits the impact of the canopy pole (44) on the jib (8, 8*a*).

13. The free-arm canopy, as set forth in one of claim 1, is characterized by the fact that the connecting strut (16, 18, 16*a*, 18*a*) is positioned in an adjustable manner.

14. The free-arm canopy, as set forth in claim 13, is characterized by the fact that the connecting strut (16, 18, 16*a*, 18*a*) is provided at least on one end with a row of boreholes (22) for selectively fastening a connecting bolt (14, 20, 14*a*, 20*a*).

15. The free-arm canopy, as set forth in claim 13, is characterized by the fact that a connecting bolt (20*a*) of the connecting strut (16, 18, 16*a*, 18*a*) can be fastened to the mast (2*a*) at various vertical positions.

16. The free-arm canopy, as set forth in claim 13, is characterized by the fact that the connecting strut comprises with two connecting elements (16, 18 or 16*a*, 18*a*), located parallel to each other, comprised of a flat material, and which are interconnected with one another in the central area of their length via a connecting link (24, 24*a*).

17. The free-arm canopy, as set forth in claim 13, is characterized by the fact that the connecting strut (16, 18) is articulated on the end of the jib (8) which faces away from the canopy (10), and that the first detent device (36) has a connecting device (38), which is secured at various lengths between the connecting strut (16, 18) and the mast (2).

18. The free-arm canopy, as set forth in claim 13, is characterized by the fact that the end of the jib (8*a*), which faces away from the canopy (10), is articulated secured to a slide (92) which can be slid along the mast (2*a*), and that the slide can be secured at various heights on the mast (2*a*) by means of a first detent device (100), while the connecting strut (16*a*, 18*a*) is articulated on the one hand at the upper end of the mast (2*a*) and on the other hand between the ends of the jib (8*a*).

19. The free-arm canopy, as set forth in claim 1, is characterized by the fact that a canopy pole (44) is articulated on the jib (8, 8*a*), while the slider (54) has been provided with a guiding device (200) which at least in the open state of the canopy (10) interacts with the canopy pole (44), while the canopy can be secured in the open state by means of a disengaging second detent device (202).

20. The free-arm canopy, as set forth in claim 19, is characterized by the fact that the canopy (10) in the open state in at least one angular position in relation to the axis of the jib (8, 8*a*) and at least in one swivel direction can be secured by means of a third detent device (210), while the third detent device (210) comprises a longitudinally adjustable detent element (212) with an upper stop face (214), located inside the canopy pole (44) with an upper stop face (214) which, when opening the canopy, can slide upward in such a way that the stop face (214) interacts with a stop (216) on the jib (8,8*a*).

21. The free-arm canopy, as set forth in claim 20, is characterized by the fact that the crown (46) embraces the canopy pole (44) and can slide along the latter in a longitudinal direction, while the crown (46) is connected to the detent element (212) of the third detent device (210) by means of at least one connecting bolt (220), which is guided through longitudinal slots (218) in the canopy pole (44), while the downward movement of the crown (46) is limited by the lower ends (222) of the longitudinal slots (218) and the upward movement of the crown (56) is limited by the upper ends (224) of the longitudinal slots (218).

22. The free-arm canopy, as set forth in claim 20, is characterized by the fact that a frontal face (227) of the detent element (212) or the stop (216) of the jib (8, 8*a*) has been provided with several recesses (228, 228', etc.) into which the respective counter element can selectively engage in the open state of the canopy (10) according to the desired angular position of the canopy pole (44).

23. The free-arm canopy, as set forth in claim 22, is characterized by the fact that a provision has been made for a pulling device (234), which is connected to the detent element (212), and by means of which—in the open state of the canopy (10)—the stop face (214) of the detent element (212) can be disengaged from the stop (216) by overcoming an upwardly directed tension of the canopy.

* * * * *

UNITED STATES PATENT AND TRADEMARK OFFICE

CERTIFICATE OF CORRECTION

PATENT NO. : 6,014,980
DATED : January 18, 200
INVENTOR(S) : Gustav Adolf Glatz

It is certified that error appears in the above-identified patent and that said Letters Patent is hereby corrected as shown below:

Foreign Application Priority Data:

On the title page, box [30], please delete "Jul. 25, 1995" and insert -- July 27, 1995 --.

Signed and Sealed this

Twenty-seventh Day of February, 2001

Attest:

Nicholas P. Godici

NICHOLAS P. GODICI

Attesting Officer

Acting Director of the United States Patent and Trademark Office